US005549294A

United States Patent [19]

Wellen et al.

[11] Patent Number: 5,549,294

[45] Date of Patent: Aug. 27, 1996

[54] HAND PADDLE

[76] Inventors: Alexander B. Wellen, 901 Clinton St., Apt. 11, Philadelphia, Pa. 19107; Allan A. Fanucci, 242 Florence Rd., Harrington Park, N.J. 07640

[21] Appl. No.: 373,470

[22] Filed: Jan. 17, 1995

Related U.S. Application Data

[63] Continuation-in-part of Ser. No. 292,450, Aug. 18, 1994, abandoned.

[51] Int. Cl.[6] ..... A63B 59/00

[52] U.S. Cl. ..... 273/67 B; 273/76

[58] Field of Search ..... 273/67 R, 67 B, 273/346, 30, 73 R, 76, 75, 318; D21/213

[56] References Cited

U.S. PATENT DOCUMENTS

| | | | |
|---|---|---|---|
| D. 256,938 | 9/1980 | Castelli | D21/213 |
| D. 256,939 | 9/1980 | Castelli | D21/213 |
| D. 257,867 | 1/1981 | Castelli | D21/213 |
| 1,930,281 | 10/1933 | Ogden | 273/67 |
| 2,987,316 | 6/1961 | Butera | 273/67 |
| 4,227,692 | 10/1980 | Castelli | 273/67 R |
| 4,516,774 | 5/1985 | Nankivell | 273/67 B |
| 5,018,732 | 5/1991 | Kraemer et al. | 273/67 B |
| 5,236,191 | 8/1993 | Capriati | 273/67 B |
| 5,261,673 | 11/1993 | Miller | 273/346 |

FOREIGN PATENT DOCUMENTS

| | | | |
|---|---|---|---|
| 2525480A | 4/1982 | France . | |
| 444407 | 7/1926 | Germany | 273/67 B |
| 156982 | 1/1939 | Germany . | |
| 7605224 | 9/1977 | Netherlands | 273/67 B |
| 2030871 | 4/1980 | United Kingdom . | |

*Primary Examiner*—Mark S. Graham
*Attorney, Agent, or Firm*—Pennie & Edmonds

[57] ABSTRACT

The present invention relates to a hand paddle that has first and second paddle members which are spaced apart to receive a user's hand therein, and which each have a top portion, a bottom portion, and outer and inner surfaces. This paddle includes post members for connecting the paddle members together in a manner which maintains the outer surfaces in substantially parallel alignment. It also has first and second compressible layers positioned on the inner surfaces of the first and second paddle members, respectively. These layers are spaced apart and face each other with the spacing between the layers at the top portion of the paddle members being less than the spacing between the layers at the bottom portion of the paddle members so that a user's hand is snugly received therebetween.

19 Claims, 5 Drawing Sheets

HAND PADDLE

This application is a continuation in part of application Ser. No. 08/292,450 filed on Aug. 18, 1994, now abandoned.

TECHNICAL FIELD

The present invention relates to a paddle construction for playing games such as table tennis and paddleball, and more particularly, to a paddle which is easy to manipulate because it is placed directly onto and around the user's hand.

BACKGROUND ART

Tedious practice and experience are required in order to become proficient at games that require the use of a hand paddle, such as table tennis. Although practice and experience are part of the challenge that people look for in the game, beginners often become frustrated and impatient with the conventional paddle's playablility. Similarly, average and advanced players often find the construction of the conventional paddle restricting.

Player limitations are partly due to the handle of a conventional paddle. Players often have difficulty gripping the conventional paddle handle correctly; consequently not being able to play the game successfully. New hands on a conventional table tennis paddle tend to slide down from the proper grip position to one in which they are holding the paddle near its end. This causes improper leverage and in turn, can cause inaccurate shots.

In order to make sound strokes with conventional paddles, the racquet must be properly gripped. Compared to all racquet sports, table tennis is played with the smallest ball and racquet, and has the smallest target. Therefore, the angle at which the paddle is presented to the ball, during the swing, must be precise. Any minor deviation from the correct grip on the paddle can cause gross errors in shotmaking and errors in form.

Players often find that they must adjust their racquet grip constantly in order to change from a forehand shot to a backhand shot and vice versa. By continually adjusting the grip of the racquet, players steadily lose some control. Consequently, shotmaking becomes increasingly difficult.

Using the handle to orient the paddle to meet the ball precisely in the right place and at the right time is very difficult. The significant flaw in the conventional paddle design is the external racquet handle; its awkwardness has limited the amount of players who can play the game successfully and well.

It has been recognized that two similar paddles interconnected, by spacers, and encompassing the hand of the player, should increase the enjoyment of, and the number who, may enjoy table tennis. Such a paddle presents the player with an almost unlimited assortment of strokes. The elimination of the conventional paddle's handle allows the hand of the player to act almost instinctively in orienting the paddle to meet the ball. Use of such a paddle provides a natural feeling when in use and creates a quicker and more exciting game. Using one's arm instead of a racquet handle adds speed and control to the strokes and shots. The paired striking panels increase the player's dexterity and quicken the player's response time. See, e.g., Ogden, U.S. Pat. No. 1,930,281.

Since Ogden, however, a variety of paddles have been developed to improve upon the game by eliminating the cumbersome handle of the conventional paddle. To compensate for the eliminated handle, some disclosures illustrate a second paddle a sufficient distance apart from the first, at an interval sufficient to accept a player's hand between them. See Butera, U.S. Pat. No. 2,987,316; Castelli, U.S. Pat. No. 4,227,692.

There are a variety of methods created to secure the player's hand to the inclined or parallel surfaces. Ogden, U.S. Pat. No. 1,930,281 and Castelli, U.S. Pat. No. 4,227,692 each disclose two paddles with a rigid central handle or post located in between the parallel striking surfaces. The Castelli post is perpendicular to the striking panels and affords a means for securing the panels. In contrast, the Ogden paddles are supported by stays which also hold the handle parallel and equidistant from the striking surfaces.

Others have tried to secure the hand in place by adjusting the size of the paddles or their distance from one another, or both, as follows: Castelli, U.S. Pat. No. Des. 257,867 (pointed oval); Wagner, Netherlands Pat. No. 76-05224 (bat or striker entirely enclosing player's hand); Castelli, Great Britain Pat. No. 2,030,871 (sheath or mitten masking greater part of palm and back of player's hand); Kovar, Germany Pat. No. 156,982 (rectangular paddles with extensions for player's wrist).

Some disclosures change the texture of the inside gripping, flat surface for the purpose of preventing the paddle from slipping off the hand during play. Butera, U.S. Pat. No. 2,987,316, for example, describes inside surfaces of the panels which may be coated with a non-skid material to assist in this gripping function.

Alternatively, the prior art discloses an assortment of means to secure the player's hand to the striking surfaces. Among the disclosures include finger straps, crisscrossed hand straps, and wrist straps. See German Pat. No. 156,982; French Pat. No. 2,525,480; Netherlands Pat. No. 76-05224. Others disclose ribs fitted for finger tips, additional flat, textured surfaces, and contoured palm and finger support regions. See Netherlands Pat. No. 76-05224; Castelli, U.S. Pat. No. Des. 256,939; Nakievell, U.S. Pat. No. 4,516,774. However, none of these patented designs has ever become commercially successful.

Less restrictive, natural fitting sporting equipment can assist a player's ability to perfect eye-hand coordination. Handles, posts, straps, and ribs can inhibit a player's natural racquet swing. In baseball, for example, a player must align the center of his or her hand precisely with the ball. Similarly, table tennis requires the player to make his or her best efforts to contact the center or "sweet spot" of the racquet. Thus, a two-sided paddle where the striking surfaces are not parallel to one another or centered with the center of the player's hand increases the difficulty of eye-hand coordination.

Thus, there remains a need for an improved hand paddle where the striking surfaces are separated apart in parallel alignment and the player's hand lays substantially flat and is comfortably secured between two parallel striking surfaces. The present invention provides one construction to satisfy this need.

SUMMARY OF THE INVENTION

The present invention relates to a hand paddle that has first and second paddle members which are spaced apart to receive a user's hand therein, and which each have a top portion, a bottom portion, and outer and inner surfaces. This paddle includes means for connecting the paddle members together in a manner which maintains the outer surfaces in substantially parallel alignment. It also has first and second compressible layers positioned on the inner surfaces of the first and second paddle members, respectively. These layers are spaced apart and face each other with the spacing between the layers at the top portion of the paddle members being less than the spacing between the layers at the bottom portion of the paddle members so that a user's hand is snugly received therebetween.

Preferably, the first and second paddle members are substantially flat and the first and second compressible layers are tapered from a greater thickness at the top portion of the paddle members to a lesser thickness at the bottom portion of the paddle members. Also, the compressible layers are preferably made of a compressible foam material and have a gradual taper from the top portion of the paddle members to the bottom portion.

At least one of the compressible layers preferably includes elongated grooves for receiving the fingers of the user's hand. Advantageously, both compressible layers include such grooves.

The connecting means preferably comprises a pair of post members which are attached to the paddle members. If desired, the post members may be arranged in a position where at least one can be grasped by the thumb of a user's hand for better control of the paddle. For a paddle that can be used by right or left hand players, the post members are arranged in a symmetrical position so that one can be grasped by the thumb of a user's right or left hand.

Another embodiment of the invention relates to a hand paddle comprising first and second paddle members being spaced apart to receive a user's hand therein, each having a top portion, a bottom portion, and outer and inner surfaces; means for connecting the paddle members together in a manner which maintains the outer surfaces in substantially parallel alignment; and a raised portion positioned on the inner surface of one of the first and second paddle members for grasping by the user's fingers.

The raised portion may be provided by a rod member the forward edge of which may include depressions for receiving the fingertips of the user's hand. Advantageously, the rod member can include a pair of leg members which are attached to the inner surface of the paddle member so that the rod member is spaced from the inner surface of the paddle member and extends between the post members. Also, the raised portion can be covered by a compressible layer, or the inner surface which does not include the raised portion includes a layer of compressible material.

At least one of the inner surfaces may include a raised portion for grasping by the user's fingers. If desired, the other inner surface may include a recess which conforms to the raised portion. Preferably, the conforming means comprises a compressible layer configured and dimensioned so that a user's hand is snugly received therebetween. Conveniently, the raised portion is provided by a rod member which is placed on the inner surface of the paddle member beneath the compressible layer. Also, the compressible layer at the forward edge of the rod member may include depressions for receiving the fingertips of the user's hand, again to provide better control of the paddle. This rod member may extend between the post members for optimum positioning.

When the hand paddle is to be used for playing table tennis, one or both of the outer surfaces should include a pebbled elastomeric or thermoplastic striking surface.

BRIEF DESCRIPTION OF THE DRAWINGS

Further benefits and advantages of the invention will become apparent from a consideration of the following descriptions given with reference to the accompanying drawing figures which specify and show preferred embodiments of the invention, and wherein.

DETAILED DESCRIPTION OF THE PREFERRED EMBODIMENTS

Figure 1:
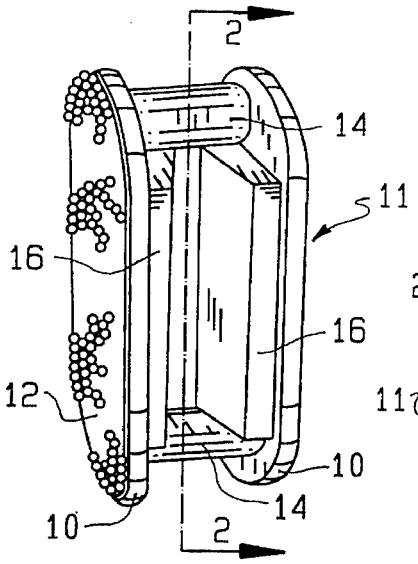
FIG. 1 is a perspective view of one form of the paddle of the present invention.

Referring now to FIGS. 1–5 there is illustrated a hand paddle or racquet construction 11 comprising a pair of paddle members 10 each of which are generally oval-shaped in configuration and provided with planar inner and outer surfaces. The paddle members 10 are constructed from wood, such as plywood, plastic, composites, or any other type of material which is traditionally used to make conventional table tennis or other hand paddles. The matching paddle members 10 are held parallel from each other by a pair of spacers 14 which are constructed of relatively rigid material such as wood and which are connected to the inner faces of the paddle members 10. Each of the spacers 14 is elongated and relatively narrow in width and proved with rounded ends as designated by the numeral 22 and are spaced substantially parallel each other as well as to the pair of paddle members 10. This parallel arrangement of the playing surfaces allows the user to be able to accurately stroke the ball with either a forehand or backhand swing.

The inner surfaces of the paddle members 10 include a layer of a compressible material, such as foam rubber, polyurethane foam, or other similar porous materials 16. Layers 16 preferably have a wedge shape which is thicker at the end of the paddle where the users fingers are positioned but which is thinner where the bottom of the user's palm and wrist are positioned. Thus, layers 16 converge towards each other to compress and conform to the hand of the user when it is inserted therebetween. This provides a secure fit of the paddle onto the user's hand and facilitates the operation of the paddle as an extension of the user's hand. Such construction allows the user to more easily learn how to stroke the ball in a manner which is more natural and comfortable than by grasping a paddle or racquet handle.

Figure 2:
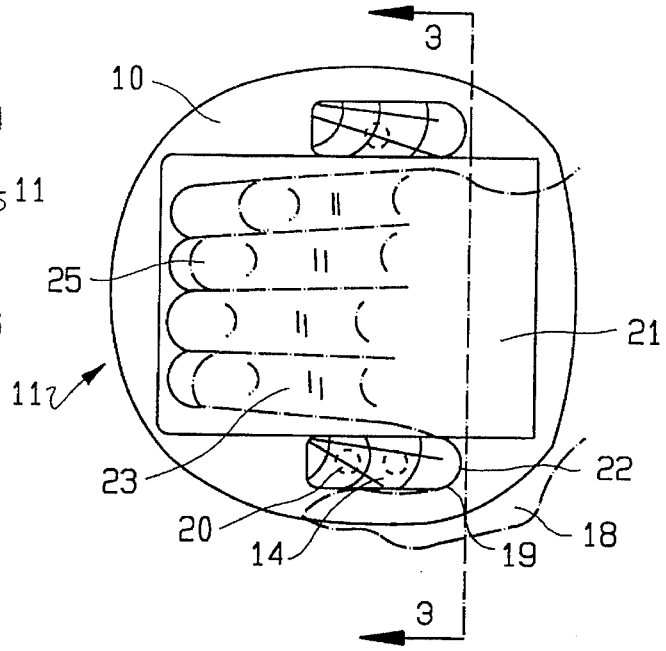
FIG. 2 is a sectional view taken substantially upon a plane passing along section line 2—2 of FIG. 1.
Figure 3:
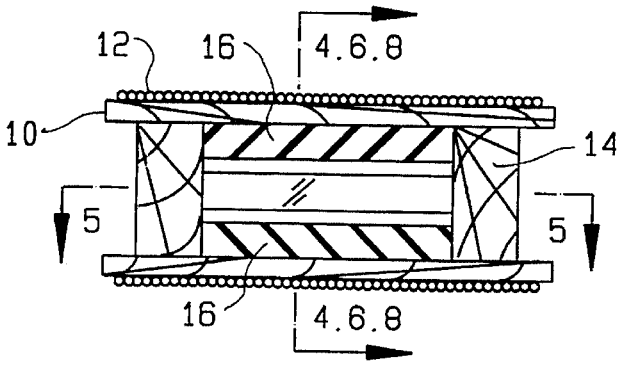
FIG. 3 is a transverse, sectional view taken substantially upon a plane passing along section line 3—3 of FIG. 2.

FIGS. 2–3 illustrate that the two paddle members 10 remain parallel to one another. This facilitates the operation of the paddle in either the forehand or backhand mode. By arranging the striking surfaces of the paddle in a parallel orientation, the user can more easily make forehand or backhand shots since the striking surfaces are perpendicular to the ball. This cannot occur when the striking surfaces are other than parallel to each other.

The relationship of the paddle members 10 and spacers 14 to the hand is represented in FIG. 2, which clearly shows that the distance between the spacers or partitions 14 is such that the forefingers 23 on either a left or right hand 21 may be inserted therebetween with the thumb 18 lying against the outer surface of one of the spacers 14. The substantially rounded ends 22 of the spacers 14 hug and thus comfortably receive the inside area of the user's thumb and hand 19.

FIG. 2 illustrates a preferred configuration where both spacers 14 are parallel to each other. Both spacers are also offset slightly, equally and parallel, from the side edges of the paddle members 10. This construction allows the center of the user's hand to lie substantially close the center of the paddle's striking surfaces 12. The parallel striking surfaces 11 centered with the center of the player's hand 21 reduce the difficulty of eye-hand coordination, thus allowing a user to master the strokes more rapidly. Thus, paddle construction 11 provides a natural feeling when in use.

All racquet sports generally set the striking surfaces parallel of the racquet or paddle to one another. This is done to eliminate some of the difficulty players have in orienting the paddle in a proper manner so that the paddle will meet the ball precisely in the right place and at the right time. The paddle construction 11 preserves this natural, straight, rigid extension by setting the striking surfaces 12 parallel to one another while comfortably receiving and accommodating the user's hand between the surfaces.

Due to the symmetry of the paddle members 10, spacers 14, and supports 16 and the parallel nature of the paddle members 10, the paddle 11 may be used effectively for engagement with a table tennis ball, handball or other similar game ball. The device has been carefully designed to be conveniently used with either a left or right hand. If desired, however, the device can be particularly configured for use with only one hand. This type of this paddle construction 11 completely eliminates the handle of a conventional paddle while allowing the hand of the user to remain substantially flat and parallel with the striking surfaces and to act instinctively in orienting the paddle to the ball.

The outer surface of the pair of paddle members 10 are provided with a pebbled elastomeric or thermoplastic material 12 of a non-skid nature which may be that type of material which is traditionally applied to the surface of a conventional table tennis paddle. Other surface coatings may be utilized, if desired, depending upon the intended use of the paddle. For example, if the paddle is to be used for paddleball, a smooth, hard surface would be preferred.

The paddle members 10 are retained in substantially parallel orientation by the spacers 14. Preferably, both the spacers 14 and the paddle members 10 are made of wood and are secured by screws 20. Alternatively, an adhesive, tacks or nails, bolts, dowels or other fastening means can be used. When the paddle is utilized for table tennis, it is advantageous for the screws 20 to be countersunk into the paddle members 10 so that they do not protrude from the playing or striking surfaces 12. Thus, the outer surfaces 12 can be attached to the paddle members 10 by an adhesive, or the like, and remain in a relatively flat configuration, without bumps or other protrusions from the screw heads. This facilitates smoother play.

Figure 4:
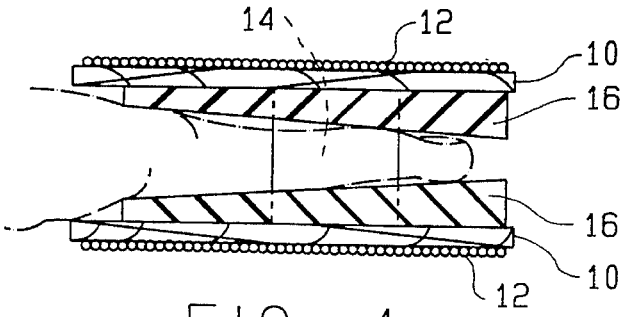
FIG. 4 is a longitudinal, vertical sectional view taken substantially upon a plane passing along section line 4— 4 of FIG. 3.
Figure 5:
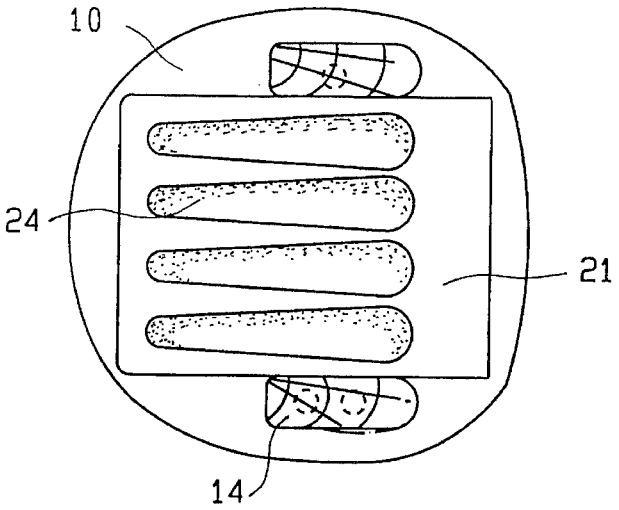
FIG. 5 is a sectional view taken substantially upon a plane passing along section line 5—5 of FIG. 3 displaying equal finger impressions.

FIG. 4 illustrates the converging wedge-shaped layers 16 for accommodating and fictionally engaging the taper of the hand 21. In addition, FIG. 5 illustrates that layer 16 of each paddle member 10 contains four equal elongated depressions 24 which receive either the top or bottom of the player's fingers 23 and which also properly retains the hand 21 in place. The contoured finger depressions 24 and the layers 16 create a less restrictive, natural fit which assists the player in his ability to perfect eye-hand coordination and preserve a player's natural racquet swing. Thus, the parallel surface of the paddle members 10 is preserved while the palm or thick portion of the hand 21 is received between the portion of the layers 16 which are spaced the greatest distance apart.

Figure 6:
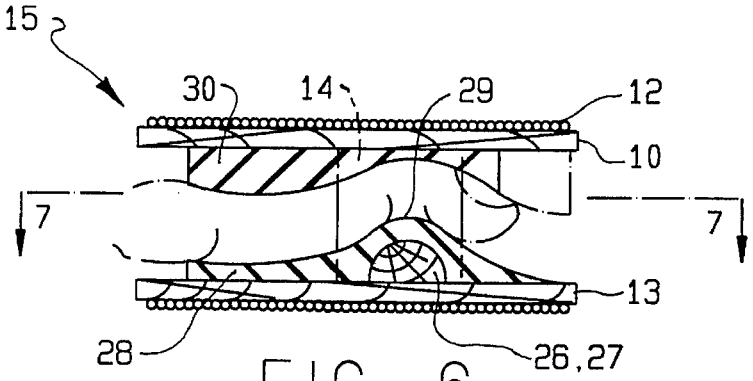
FIG. 6 is a longitudinal, vertical sectional view of another embodiment of the invention, taken substantially upon a plane passing along section line 6—6 of FIG. 3.
Figure 7:
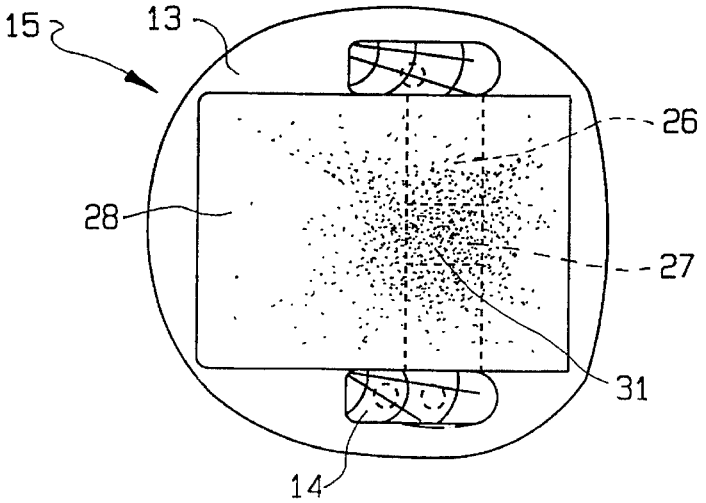
FIG. 7 is a sectional view taken substantially upon a plane passing along section line 7—7 of FIG. 6 displaying a bump.

FIGS. 6–7 illustrate another embodiment 15 of the invention where only the compressible layers 28 and 30 are changed and shaped to receive and secure the player's hand 21 in a substantially flat position which is parallel to the striking surfaces. FIG. 7 illustrates a block or dowel 26 or 27 bonded to paddle member 13 between spacers 14. The compressible layer 28 which is placed over the dowel 26 creates a bulge or bump 29 of a length which is about the same as the distance between the spacers 14. This bump 29 combined with the compressible layer 30 sandwiches the player's hand into place. Alternatively, a compressible layer 28 can be placed over the dowel 27 creating a shorter bump 31. This bump 31 combined with the compressible layer 30 allows the player to cup, grasp, or cover the full bump 31 with his palm. This bump 31 combined with the compressible layer 30 secures the player's hand 21 in place between the paddle members 10 and 13.

Figure 8:
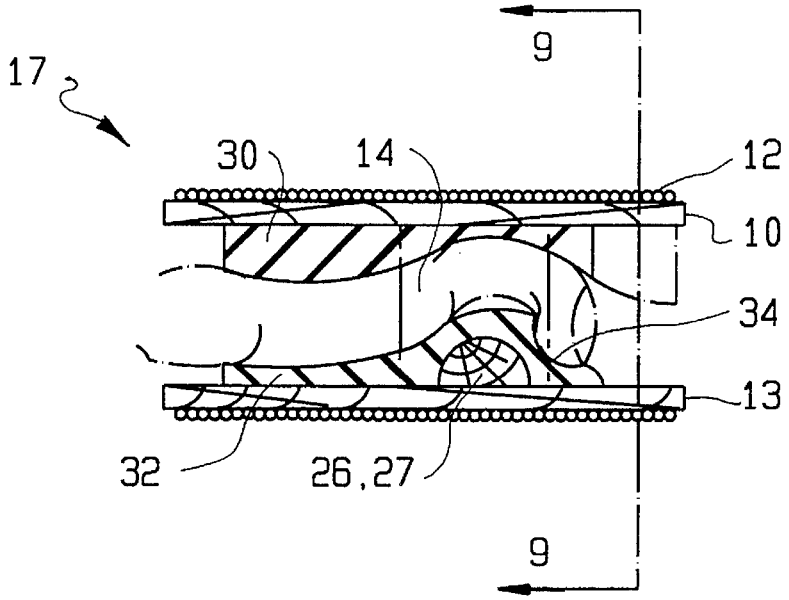
FIG. 8 is a longitudinal, vertical sectional view of a further embodiment of the invention, taken substantially upon a plane passing along section line 8—8 of FIG. 3.
Figure 9:
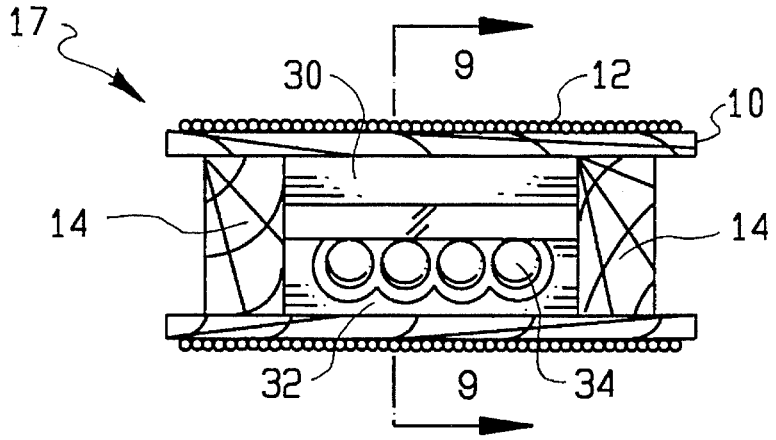
FIG. 9 is a sectional view taken substantially upon a plane passing along section line 9—9 of FIG. 8 displaying finger hole impressions.

FIGS. 8–9 illustrate a further embodiment 17 of the compressible layers 28 and 30 described in FIGS. 6–8 where the compressible layer 32 contains four finger tip impressions 34. This embodiment allows the player's finger tips 25 to curl around the compressible layer 32, slide into the finger tip impressions 34, and the hand 21 to grasp the compressible layer 32. This compressible layer 32 preserves the substantially parallel nature of the player's hand 21 to the paddle members 10 and 13. Paramount to both embodiment 15 and 17 is the fact that despite the change in the shape of the compressible layer 32, the paddle members 10 and 13 remain substantially parallel to one another to provide the advantages discussed above.

Figure 10:
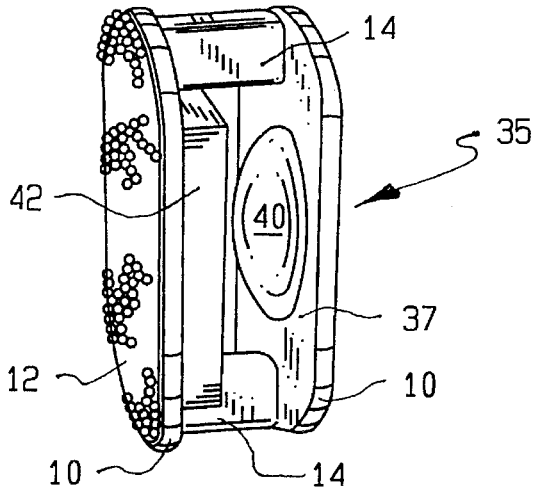
FIG. 10 is a perspective view of another form of the paddle of the invention.
Figure 11:
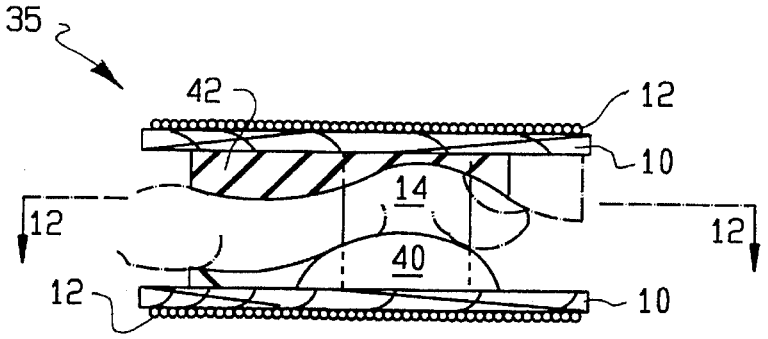
FIG. 11 is a side view of the paddle of FIG. 10.
Figure 12:
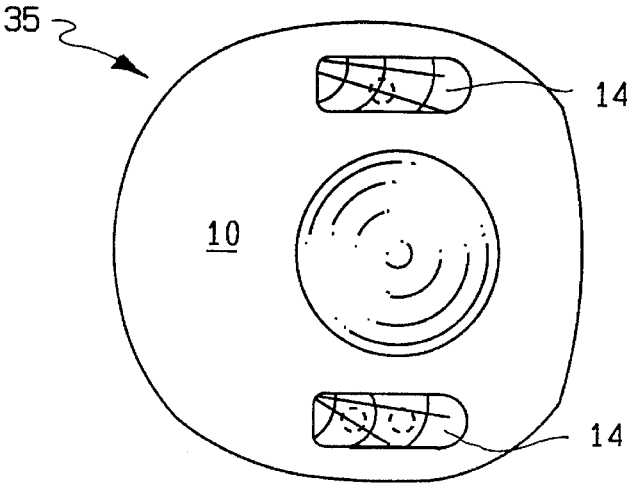
FIG. 12 is a longitudinal, vertical sectional view taken substantially upon a plane passing along section line 12—12 of FIG. 11.

FIGS. 10–12 illustrate another embodiment 35 of the invention. Again, the paddle includes front and rear inner surfaces 10, pebbled outer surfaces 12, and spacers 14. In this embodiment, one of the inner surfaces 37 includes a raised portion 40 in the shape of a portion of a sphere. This portion 40 can easily fit in the palm of the user's hand to thus allow easy control of the paddle. The other inner surface does not require a compressible layer, since the curvature of the fingers provides a relatively flat configuration for the back of the hand which nicely engages the other inner surface of the paddle member. For a more secure fit of the paddle on the user's hand, a layer 42 of compressible material may be included. This layer 42 may be positioned and configured to conform to the back of the player's hand 39, and may include a recess or other means which provides a lesser thickness opposite the sphere. If desired, layer 42 may be tapered like those of FIG. 1.

Preferred items for use as the raised portion may be made of any solid or hollow material, depending upon the preference of the user. A portion of a foam or plastic ball, such as a tennis ball, or a shaped block of wood can be adhered to inner surface 37 to form the raised portion. Of course, the softer, hollow materials will provide a level of compressibility which may be desired for close or short tolerances of the spacers, while solid or rigid materials would be preferred for gripping.

The shape of the raised portion is not critical. For convenience, a spherical portion is shown in FIGS. 10–12, but other shapes can be used. Such usable shapes include a solid or hollow cylindrical portion, an oval sphere, or a rounded bar or rod. Since a primary function of the raised portion is to facilitate gripping or engagement by the user's hand, any shape which is comfortable to grasp can be used.

Figure 13:
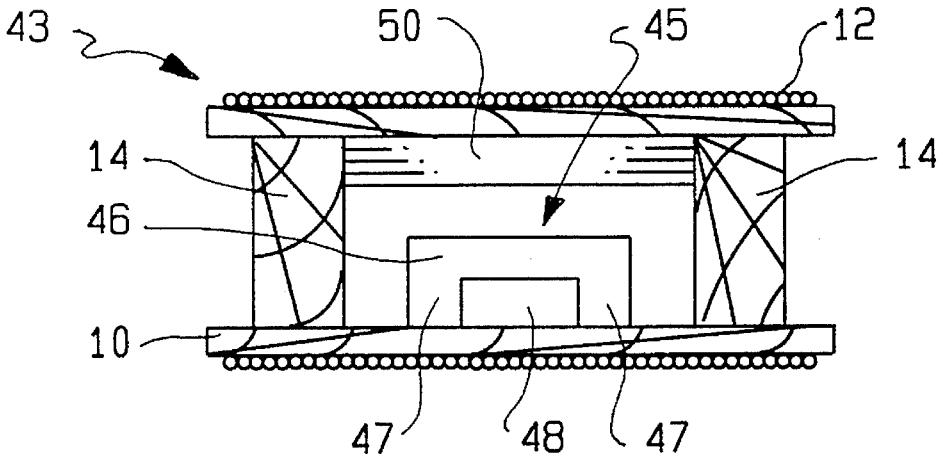
FIG. 13 is a side view of an alternative embodiment of the paddle of FIG. 10.
Figure 14:
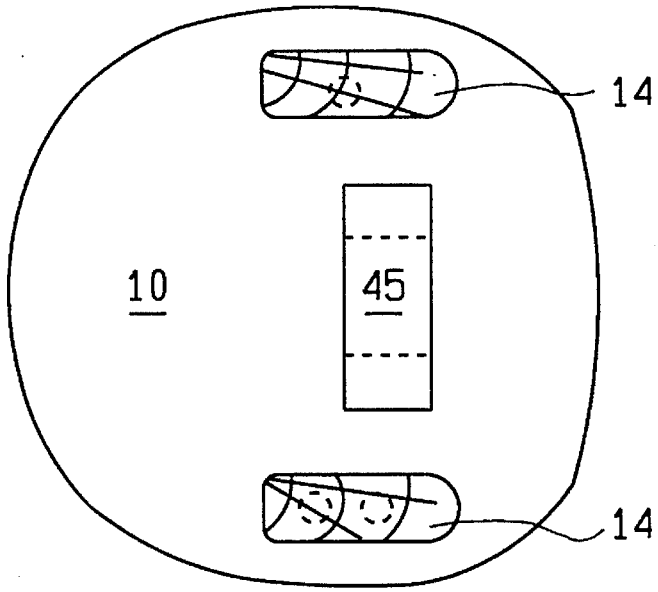
FIG. 14 is a sectional view taken substantially upon a plane passing along section line 14—14 of FIG. 13.

FIGS. 13–14 illustrate the use of another paddle 43 which includes raised portion 45, this being in the shape of a raised block or dowel 46 which is mounted to the inner surface 10 of the paddle member by legs 47 or other similar spacers. In this embodiment, the used can grasp the dowel 45 to securely handle the paddle. Alternatively, the space 48 between the dowel and the inner surface of the paddle can be made sufficiently large to accommodate at least some of the user's fingers therein. In combination with the compressible layer 50 of the other inner surface, a very secure mounting of the paddle to the user's hand is achieved.

As noted above, it is also possible to place another compressible layer over the raised portion. This again restricts the open area between the paddle members to achieve a greater level of compression force on the user's hand so that a more secure fit can be made. Of course, the area should not be reduced too small so that the paddle is uncomfortable. If the area is too large, the user may curve or bend their fingers around the raised portion to increase the effective thickness of their hand to more securely retain the paddle in position during use thereof.

For greater grasping of the raised portion, finger tip impressions may be included on the front face of the dowel 46 or on the forward surface of the raised portion in the same manner as described above with regard to FIGS. 8 and 9.

If desired, the racquet of the invention can include a wrist strap, as shown in the Castelli French Patent No. 2,525,480, or other similar device to secure the paddle to the user's wrist or arm. This is particularly useful when the racquet is used for paddleball or other sports where greater arm swings are used.

While there has been shown and described what are considered to be preferred embodiments of the invention, it will of course be understood that various modifications and changes in form or detail could readily be made without departing from the spirit of the invention. It is therefore intended that the invention be not limited to the exact form and detail herein shown and described, nor to anything less than the true spirit and scope of the invention as hereinafter claimed.

What is claimed is:

1. A hand paddle comprising:

first and second paddle members being spaced apart to receive a user's hand therein, each having a top portion, a bottom portion, and outer and inner surfaces;

means for connecting the paddle members together in a manner which maintains the outer surfaces in substantially parallel alignment; and first and second compressible layers positioned on the inner surfaces of the first and second paddle members, respectively, which layers are spaced apart and facing each other with the spacing between the layers at the top portion of the paddle members being less than the spacing between the layers at the bottom portion of the paddle members so that a user's hand is snugly received therebetween.

2. The paddle of claim 1 wherein the first and second paddle members are substantially flat and the first and second compressible layers are tapered from a greater thickness at the top portion of the paddle members to a lesser thickness at the bottom portion of the paddle members.

3. The paddle of claim 2 wherein the compressible layers are made of a compressible foam material and have a gradual taper from the top portion of the paddle members to the bottom portion.

4. The paddle of claim 1 wherein at least one of the compressible layers includes elongated grooves for receiving the fingers of the user's hand.

5. The paddle of claim 1 wherein both of the compressible layers include elongated grooves for receiving the fingers of the user's hand.

6. The paddle of claim 1 wherein the connecting means comprises a pair of post members which are attached to the paddle members.

7. The paddle of claim 1 wherein the post members are arranged in a position where at least one can be grasped by the thumb of a user's hand for better control of the paddle.

8. The paddle of claim 1 wherein the post members are arranged in a symmetrical position so that one can be grasped by the thumb of a user's right or left hand for better control of the paddle.

9. The paddle of claim 1 wherein at least one of the outer surfaces includes a pebbled elastomeric or thermoplastic striking surface.

10. The paddle of claim 1 wherein each outer surface includes a pebbled elastomeric or thermoplastic striking surface.

11. A hand paddle comprising first and second paddle members being spaced apart to receive a user's hand therein, each having a top portion, a bottom portion, and outer and inner surfaces;

a pair of post members for connecting the paddle members together in a manner which maintains the outer surfaces in substantially parallel alignment; and a raised portion positioned on the inner surface of one of the first and second paddle members between said post members, wherein the raised portion is covered by a compressible layer for grasping by the user's hand or fingers.

12. The paddle of claim 11 wherein the raised portion is provided by a rod member.

13. The paddle of claim 11 wherein the inner surface which does not include the raised portion includes a compressible layer capable of conforming to the raised portion and spaced therefrom.

14. The paddle of claim 11 wherein the raised portion has a forward edge and the compressible layer at the forward edge of the rod member includes depressions for receiving the fingertips of the user's hand.

15. The paddle of claim 13 wherein the compressible layer is configured and dimensioned so that a user's hand is snugly received therebetween.

16. The paddle of claim 11 wherein the inner surface which does not include the raised portion includes a layer of compressible material.

17. The paddle of claim 16 wherein the raised portion is a spherical portion, a cylindrical portion, an oval sphere, or a rounded bar.

18. A paddle comprising:

first and second paddle members being spaced apart to receive a user's hand therein, each having a top portion, a bottom portion, and outer and inner surfaces;

a pair of post members for connecting the paddle members together in a manner which maintains the outer surfaces in substantially parallel alignment; and a raised portion positioned on the inner surface of one of the first and second paddle members between said post members for grasping by the user's fingers;

wherein the raised portion includes depressions for receiving the fingertips of the user's hand.

19. A hand paddle comprising first and second paddle members being spaced apart to receive a user's hand therein, each having a top portion, a bottom portion, and outer and inner surfaces;

a pair of post members for connecting the paddle members together in a manner which maintains the outer surfaces in substantially parallel alignment; and a raised portion comprising a rod member which includes a pair of leg members which are attached to the inner surface of one of the paddle members so that the rod member is positioned above and spaced from said inner surface of one of the first and second paddle members between said post members for grasping by the user's fingers.

* * * * *